US010619815B2

(12) United States Patent
Haese et al.

(10) Patent No.: US 10,619,815 B2
(45) Date of Patent: Apr. 14, 2020

(54) DEVICE FOR REDUCING COLOR FRINGING

(71) Applicants: Covestro Deutschland AG, Leverkusen (DE); Technische Hochschule Nürnberg Georg Simon Ohm, Nürnburg (DE)

(72) Inventors: Wilfried Haese, Odenthal (DE); Rafael Oser, Krefeld (DE); Michael Roppel, Burscheid (DE); Alexander Von Hoffmann, Altdorf (DE); Martin Gebhard, Feucht (DE); Bernhard Heck, Nürnburg (DE); Alena Taranka, Nürnburg (DE)

(73) Assignees: Covestro Deutschland AG, Leverkusen (DE); Technische Hochschule Nürnberg Georg Simon Ohm, Nürnburg (DE)

( * ) Notice: Subject to any disclaimer, the term of this patent is extended or adjusted under 35 U.S.C. 154(b) by 0 days.

(21) Appl. No.: 16/340,434

(22) PCT Filed: Oct. 9, 2017

(86) PCT No.: PCT/EP2017/075652
§ 371 (c)(1),
(2) Date: Apr. 9, 2019

(87) PCT Pub. No.: WO2018/069235
PCT Pub. Date: Apr. 19, 2018

(65) Prior Publication Data

US 2019/0234574 A1 Aug. 1, 2019

(30) Foreign Application Priority Data

Oct. 14, 2016 (EP) ..... 16193831

(51) Int. Cl.
*F21S 41/32* (2018.01)
*F21S 41/176* (2018.01)
(Continued)

(52) U.S. Cl.
CPC ..... *F21S 41/32* (2018.01); *F21S 41/143* (2018.01); *F21S 41/16* (2018.01); *F21S 41/176* (2018.01);
(Continued)

(58) Field of Classification Search
CPC ..... F21S 41/16; F21S 41/32; F21S 41/143; F21S 41/176; F21S 41/285; F21S 41/43
See application file for complete search history.

(56) References Cited

U.S. PATENT DOCUMENTS 2,991,273 A 7/1961 Hechelhammer et al.
2,999,835 A 9/1961 Goldberg
(Continued)

FOREIGN PATENT DOCUMENTS

DE 1570703 A1 2/1970
DE 2063050 A1 7/1972
(Continued)

OTHER PUBLICATIONS

International Search Report for PCT/EP2017/075652 dated Jan. 12, 2018.
(Continued)

*Primary Examiner* — Thomas M Sember
(74) *Attorney, Agent, or Firm* — Drinker Biddle & Reath LLP

(57) ABSTRACT

The present invention relates to a projection spotlight module comprising a reflector with a first focal point and a second focal point, a light source which is disposed at the first focal point of the reflector or close to the first focal point of the reflector, a lens that has its focal point in common with
(Continued)

Figure 1:
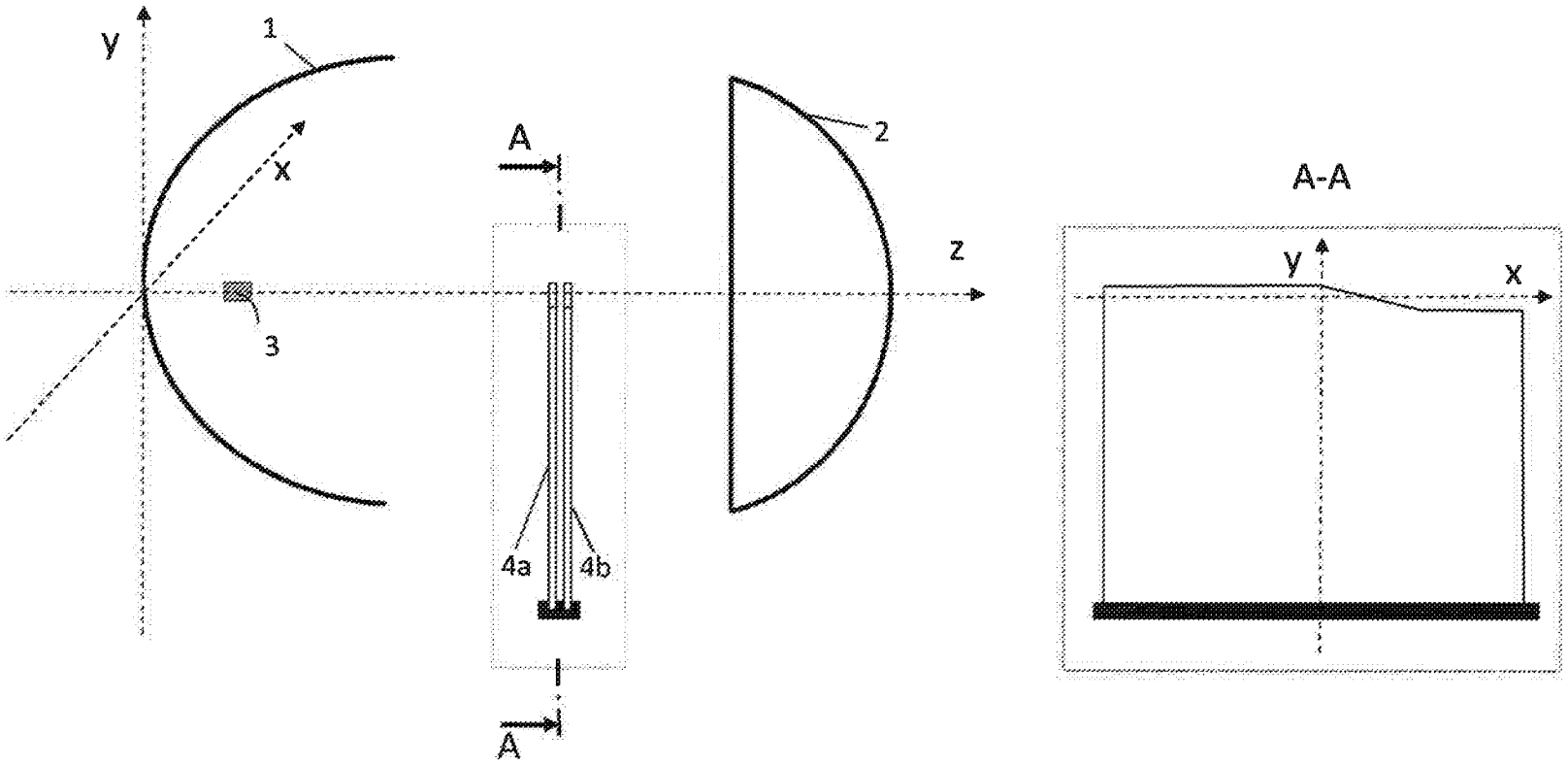

the second focal point of the reflector, and a stop system with color filters for reducing color fringing.

Projection spotlight modules according to the invention are especially suited for illumination in the automotive sector, of utility vehicles, of rail vehicles, of two-wheeled vehicles, of ships, in particular as headlights, as theater spotlights or as architectural lightings, for instance in the illumination of facades.

15 Claims, 8 Drawing Sheets

(51) Int. Cl.

| | |
|---|---|
| ***F21S 41/16*** | (2018.01) |
| ***F21S 41/143*** | (2018.01) |
| ***F21S 41/20*** | (2018.01) |
| ***F21S 41/43*** | (2018.01) |
| *F21Y 115/10* | (2016.01) |

(52) U.S. Cl.

CPC ..... *F21S 41/285* (2018.01); *F21S 41/43* (2018.01); *F21Y 2115/10* (2016.08)

(56) References Cited

U.S. PATENT DOCUMENTS

| | | | |
|---|---|---|---|
| 2,999,846 | A | 9/1961 | Schnell et al. |
| 3,148,172 | A | 9/1964 | Fox |
| 3,271,367 | A | 9/1966 | Schnell et al. |
| 3,879,348 | A | 4/1975 | Serini et al. |
| 4,851,968 | A | 7/1989 | Nino |
| 4,982,014 | A | 1/1991 | Freitag et al. |
| 5,097,002 | A | 3/1992 | Sakashita et al. |
| 5,132,154 | A | 7/1992 | Westeppe et al. |
| 5,340,905 | A | 8/1994 | Kühling et al. |
| 5,422,793 | A | 6/1995 | Kobayashi |
| 5,717,057 | A | 2/1998 | Sakashita et al. |
| 6,596,840 | B1 | 7/2003 | Kratschmer et al. |
| 7,071,284 | B2 | 7/2006 | Kauth et al. |
| 7,175,323 | B2 | 2/2007 | Bucher |
| 7,455,439 | B2 | 11/2008 | Albou et al. |
| 2005/0018440 | A1 | 1/2005 | Koike et al. |
| 2005/0225996 | A1 | 10/2005 | Fleury et al. |
| 2005/0225999 | A1 | 10/2005 | Bucher |

FOREIGN PATENT DOCUMENTS

| | | | |
|---|---|---|---|
| DE | 2063052 | A1 | 7/1972 |
| DE | 2211956 | A1 | 10/1973 |
| DE | 3832396 | A1 | 2/1990 |
| DE | 3918406 | A1 | 12/1990 |
| DE | 4329332 | A1 | 3/1994 |
| DE | 10355747 | A1 | 3/2005 |
| DE | 102013227194 | A1 | 7/2015 |
| EP | 0108915 | A1 | 5/1984 |
| EP | 0390208 | A2 | 10/1990 |
| FR | 1561518 | A | 3/1969 |
| GB | 1122003 | A | 7/1968 |
| GB | 1229482 | A | 4/1971 |
| GB | 1367788 | A | 9/1974 |
| GB | 1367790 | A | 9/1974 |
| JP | H02103801 | A | 4/1990 |
| JP | H10302506 | A | 11/1998 |
| WO | WO-200105866 | A1 | 1/2001 |
| WO | WO-2004063249 | A1 | 7/2004 |
| WO | WO-2015052106 | A2 | 4/2015 |

OTHER PUBLICATIONS

Written Opinion of the International Searching Authority for PCT/EP2017/075652 dated Jan. 12, 2018.

DEVICE FOR REDUCING COLOR FRINGING

CROSS-REFERENCE TO RELATED APPLICATIONS

This application is a national stage application (under 35 U.S.C. § 371) of PCT/EP2017/075652, filed Oct. 9, 2017, which claims benefit of European Application No. 16193831.1, filed Oct. 14, 2016, both of which are incorporated herein by reference in their entirety.

The present invention relates to a projection spotlight module comprising a reflector with a first focal point and a second focal point, an LED light source, the light from which is composed of a first wavelength range a and of light from a second wavelength range b, where the light source is disposed at the first focal point of the reflector or close to the first focal point of the reflector, a lens that has its focal point in common with the second focal point of the reflector, and a stop system. The invention further provides for use of such projection spotlight modules.

Vehicle lighting in most countries comprises low-beam light by law. This ensures one's own visibility and lighting of the road. In terms of brightness and geometry, the light has to be such that neither oncoming traffic nor other road users are dazzled. For this purpose, the projection module of an automobile headlight, typically comprising a light source, a reflector and an optical lens, typically shows a relatively clear light/dark boundary in the light path that arises through use of a stop. The stop is typically disposed between lens and reflector of the projection module, where the second focal point of the reflector and the focal point of the lens coincide. The stop is positioned in the lower part of the light path between the light source and the reflector. The outline of the lens defines the form of the light/dark boundary. The inverting properties of the lens result in movement of the shadows cast into the upper light path.

What is common to all light sources is that an unwanted color fringe is perceptible when they are used in what are called projection modules in automobile headlights. This color fringe is perceptible to a very particularly troublesome degree particularly in the region of the light/dark boundary in the low-beam function.

A color fringe is a colored strip of light caused by chromatic aberration. In automobile headlights, blue color fringes in particular are not just perceived as troublesome but can even confuse oncoming traffic since confusion with blue light from police or ambulance vehicles can occur at first glance.

Approaches concerned with the elimination of the color fringe are known from the prior art. For example, a vertical reduction in contrast and associated softening of the light/dark boundary reduces the perceptibility of a color fringe, as described in EP 0 390 208 A2, DE 4329332 A1 and U.S. Pat. No. 7,455,439 B2. It was also possible, described in U.S. Pat. No. 4,851,968 A for example, to achieve a reduction in color fringe by the generating of a specific light distribution from the light source.

U.S. Pat. No. 7,175,323 B2 describes a motor-vehicle projection module that uses a transparent substrate with a mask applied to create the light/dark boundary as a stop. The configuration of the mask is said to influence the sharpness of light/dark boundary and in that way to soften the color fringe as well. In addition, the use of a color filter anywhere in the light path, on the inside of the lens and/or the substrate has been described in order to counter chromatic aberration.

US 2005/0225996 A1 describes a combination of two stops, the second having a transmitting region that leads to reduction in the sharpness of the light/dark boundary, which results in softening of the color fringe here too.

The solutions known from the prior art for reduction of the blue fringe are always associated with a reduction in the sharpness of the light/dark boundary. This is problematic, however, since most countries set global legal requirements on minimum sharpness. In Germany, according to regulation ECE R98, a minimum value for sharpness G of 0.08 is applicable (ECE R98 Annex 10, Subsection 3.2b).

The problem addressed was therefore that of providing a projection module for a lighting device, especially for an automobile headlight, in which the color fringe, especially the blue fringe, is effectively reduced with minimum change in the contrast or sharpness of the light/dark boundary.

The present invention is preferably concerned with those projection modules in which an ellipsoidal reflector or a freeform surface reflector is used. These types of reflector have two conjugated focal points. The light from one focal point, after reflection, goes through the other focal point. As a result of the shape of the reflector in combination with the arrangement of the light source at or close to the first focal point, a relatively high portion of the total light emitted is collected by the reflector. If light of a different wavelength is used, a different focal point results in each case for the reflected light of different wavelengths. Alternatively, the reflector is further preferably a freeform surface reflector.

It has now been found that, surprisingly, the color fringe, especially the blue fringe, can be reduced while maintaining the sharpness of the light/dark boundary when, in place of the stops conventionally used to create the light/dark boundary, which are typically in a homogeneous or perforated design, color filters—optionally with stops—are used as stop system and specifically positioned.

The invention therefore provides a projection spotlight module (headlight/spotlight module) comprising a reflector with a first focal point and a second focal point, an LED light source, the light from which is composed of a first wavelength range a from 380 nm to 474 nm and of light from a second wavelength range b from 475 nm to 780 nm, where the light source is disposed at the first focal point of the reflector or close to the first focal point of the reflector, a lens that has its focal point in common with the second focal point of the reflector, based in each case on the light source with its wavelength distribution, and a stop system, characterized in that the stop system comprises a first color filter and a second color filter, wherein the first color filter is disposed at the focal point of the lens or close to the focal point of the lens for a characteristic of the wavelength range a or at or close to the light intensity-averaged centroid of the array of focal points of the light rays for the individual wavelengths of the wavelength range a of the lens and the second color filter is disposed at the focal point of the lens or close to the focal point of the lens for a characteristic of the wavelength range b or at or close to the light intensity-averaged centroid of the array of focal points of the light rays for the individual wavelengths of the wavelength range b of the lens, with determination of light intensity to DIN 5031-3:1982, and wherein the first color filter has an average spectral pure transmittance, determined to CIE 38:1977, having a value of at most 15%, preferably at most 5%, for wavelength range a and a value of at least 85%, preferably at least 95%, further preferably at least 99%, for wavelength range b, and the second color filter has an average spectral pure transmittance, determined to CIE 38:1977, having a value of at least 85%, preferably at least 95%, further preferably at least 99%, for wavelength range a and a value of at most 15%, preferably at most 5%, for wavelength range b.

Rather than the pure transmittances defined, it would also be possible to choose the coefficients of spectral absorption such that the spectral coefficient of absorption of the color filter is matched to the spectral light intensity distribution of the light source, meaning that the respective coefficient of absorption is lower in the spectral regions in which lower light intensity is emitted by the light source in the spectral resolution. However, this method is less preferred owing to the much greater technical complexity of implementation.

"Focal point of the lens for a characteristic" of a wavelength range is preferably understood in accordance with the invention to mean one of the following parameters:

- the focal point for the dominant wavelength of the respective wavelength range,
- the focal point for the wavelength of the maximum intensity—peak wavelength—of the respective wavelength range,
- the light intensity-averaged centroid of the array of focal points of the light rays for the individual wavelengths of the respective wavelength range.

"The light from which is composed of a first wavelength range a and a second wavelength range b": This means that the light from the LED consists entirely or in a significant portion of light from the VIS region. The VIS region is at least the essential region of the spectrum for the present invention.

According to the invention, the "dominant wavelength" of the respective wavelength range of the light is understood to mean the wavelength which is ascertained by intersection of a straight line between the achromatic point and the color locus of the light source in this wavelength range with the spectral curve for a 20 observer (definition according to CIE 15:2004).

The "peak wavelength" is the wavelength with the maximum intensity. To ascertain the peak wavelength, a radiation-equivalent parameter, for example flux or radiation intensity, is measured with spectral resolution and plotted in a Cartesian coordinate system. On the y axis is plotted the radiation-equivalent parameter and on the x axis the wavelengths. The absolute maximum of this curve is the "peak wavelength" (definition according to DIN 5031-1 (1982)).

The light intensity is determined according to DIN 5031-3 (1982).

The present invention is concerned particularly with novel light sources, LED light sources that provide white or near-white light, for instance by the combination of blue-emitting InGaN chips with appropriate phosphor converters that generate yellow light.

Further light sources suitable in principle are those light sources that have a phosphor excited by a laser.

The light from such light sources typically has a correlated color temperature, determined to CIE 15:2004, of 2500 K to 10 000 K, preferably of 5000 K to 6000 K.

The reflector is preferably an ellipsoidal reflector or a freeform surface reflector.

In one embodiment of the projection spotlight module of the invention, it has not just one lens but also further lenses.

If the projection spotlight module comprises multiple lenses, these may be arranged either directly adjacent to one another or spaced apart from one another. These lenses may consist of the same material or different materials.

In the case of the arrangement with a lens and also in the case of a system comprising more than one lens, the lens material used may be a glass material, a thermoplastic material, a thermoset material, for example an aliphatic polycarbonate, or a silicone, which also means compositions comprising these materials and customary additives.

Suitable thermoplastic materials are polyamides, polyesters, polyphenylene sulfides, polyphenylene oxides, polyether sulfones, polysulfones, poly(meth)acrylates, polyimides, polyether imides, polyether ketones, such as PEK, PEEK or PEKK, and polycarbonates.

The lens material used is preferably a polycarbonate-based composition. "Polycarbonate-based" means that the thermoplastic composition contains at least 50% by weight, preferably at least 60% by weight, further preferably at least 75% by weight, most preferably at least 85% by weight, of polycarbonate, especially aromatic polycarbonate.

Polycarbonates in the context of the present invention are either homopolycarbonates or copolycarbonates and/or polyestercarbonates; the polycarbonates may be linear or branched in a known manner. According to the invention, it is also possible to use mixtures of polycarbonates.

The thermoplastic polycarbonates including the thermoplastic aromatic polyestercarbonates have average molecular weights $M_w$ (determined by measuring the relative viscosity at 25° C. in $CH_2Cl_2$ and a concentration of 0.5 g per 100 ml of $CH_2Cl_2$) of 20 000 g/mol to 32 000 g/mol, preferably of 23 000 g/mol to 31 000 g/mol, in particular of 24 000 g/mol to 31 000 g/mol.

A portion, up to 80 mol %, preferably from 20 mol % up to 50 mol %, of the carbonate groups in the polycarbonates used in accordance with the invention may have been replaced by aromatic dicarboxylic ester groups. Such polycarbonates, which contain both acid radicals of carbonic acid and acid radicals of aromatic dicarboxylic acids incorporated into the molecular chain, are referred to as aromatic polyester carbonates. In the context of the present invention, they are covered by the umbrella term of thermoplastic aromatic polycarbonates.

The polycarbonates are produced in a known manner from dihydroxyaryl compounds, carbonic acid derivatives, optionally chain terminators and optionally branching agents, and the polyestercarbonates are produced by replacing a portion of the carbonic acid derivatives with aromatic dicarboxylic acids or derivatives of the dicarboxylic acids, and specifically according to the extent to which carbonate structural units in the aromatic polycarbonates are to be replaced by aromatic dicarboxylic ester structural units.

Dihydroxyaryl compounds suitable for the preparation of polycarbonates are those of the formula (I)

$$HO—Z—OH \quad (I)$$

in which

Z is an aromatic radical which has 6 to 30 carbon atoms and may contain one or more aromatic rings, may be substituted and may contain aliphatic or cycloaliphatic radicals or alkylaryls or heteroatoms as bridging elements.

Z in formula (I) is preferably a radical of the formula (II)

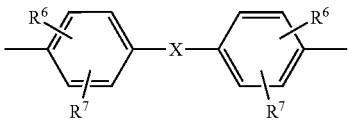

(II)

in which $R^6$ and $R^7$ are independently H, $C_1$- to $C_{18}$-alkyl-, $C_1$- to $C_{18}$-alkoxy, halogen such as Cl or Br or in each case optionally substituted aryl or aralkyl, preferably H or $C_1$- to $C_{12}$-alkyl, more preferably H or $C_1$- to $C_8$-alkyl and most preferably H or methyl, and X is a single bond, —$SO_2$—, —CO—, —O—, —S—, $C_1$- to $C_6$-alkylene, $C_2$- to $C_5$-alkylidene or $C_5$- to $C_6$-cycloalkylidene which may be substituted by $C_1$- to $C_6$-alkyl, preferably methyl or ethyl, and also $C_6$- to $C_{12}$-arylene which may optionally be fused to aromatic rings containing further heteroatoms.

Preferably, X is a single bond, $C_1$- to $C_5$-alkylene, $C_2$- to $C_5$-alkylidene, $C_5$- to $C_6$-cycloalkylidene, —O—, —SO—, —CO—, —S—, —$SO_2$— or a radical of the formula (III)

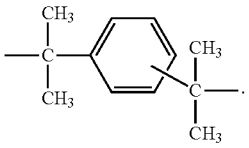

(III)

Examples of dihydroxyaryl compounds are: dihydroxybenzenes, dihydroxydiphenyls, bis(hydroxyphenyl)alkanes, bis(hydroxyphenyl)cycloalkanes, bis(hydroxyphenyl)aryls, bis(hydroxyphenyl) ethers, bis(hydroxyphenyl) ketones, bis (hydroxyphenyl) sulfides, bis(hydroxyphenyl) sulfones, bis (hydroxyphenyl) sulfoxides, 1,1'-bis(hydroxyphenyl)diisopropylbenzenes and the ring-alkylated and ring-halogenated compounds thereof.

Dihydroxyaryl compounds suitable for the preparation of the polycarbonates to be used in accordance with the invention are for example hydroquinone, resorcinol, dihydroxydiphenyl, bis(hydroxyphenyl)alkanes, bis(hydroxyphenyl) cycloalkanes, bis(hydroxyphenyl) sulfides, bis (hydroxyphenyl) ethers, bis(hydroxyphenyl) ketones, bis (hydroxyphenyl) sulfones, bis(hydroxyphenyl) sulfoxides, α,α'-bis(hydroxyphenyl)diisopropylbenzenes and alkylated, ring-alkylated and ring-halogenated compounds thereof.

Preferred dihydroxyaryl compounds are 4,4'-dihydroxydiphenyl, 2,2-bis(4-hydroxyphenyl)-1-phenylpropane, 1,1-bis(4-hydroxyphenyl)phenylethane, 2,2-bis(4-hydroxyphenyl)propane, 2,4-bis(4-hydroxyphenyl)-2-methylbutane, 1,3-bis[2-(4-hydroxyphenyl)-2-propyl]benzene (bisphenol M), 2,2-bis(3-methyl-4-hydroxyphenyl)propane, bis(3,5-dimethyl-4-hydroxyphenyl)methane, 2,2-bis(3,5-dimethyl-4-hydroxyphenyl)propane, bis(3,5-dimethyl-4-hydroxyphenyl) sulfone, 2,4-bis(3,5-dimethyl-4-hydroxyphenyl)-2-methylbutane, 1,3-bis[2-(3,5-dimethyl-4-hydroxyphenyl)-2-propyl]benzene and 1,1-bis(4-hydroxyphenyl)-3,3,5-trimethylcyclohexane (bisphenol TMC).

Particularly preferred diphenols are 4,4'-dihydroxydiphenyl, 1,1-bis(4-hydroxyphenyl)phenylethane, 2,2-bis(4-hydroxyphenyl)propane, 2,2-bis(3,5-dimethyl-4-hydroxyphenyl)propane, 1,1-bis(4-hydroxyphenyl)cyclohexane and 1,1-bis(4-hydroxyphenyl)-3,3,5-trimethylcyclohexane (bisphenol TMC).

These and further suitable diphenols are described, for example, in U.S. Pat. Nos. 2,999,835 A, 3,148,172 A, 2,991,273 A, 3,271,367 A, 4,982,014 A and 2,999,846 A, in German published specifications 1 570 703 A, 2 063 050 A, 2 036 052 A, 2 211 956 A and 3 832 396 A, in French patent 1 561 518 A1, in the monograph "H. Schnell, Chemistry and Physics of Polycarbonates, Interscience Publishers, New York 1964, p. 28 ff; p. 102 ff", and in "D. G. Legrand, J. T. Bendler, Handbook of Polycarbonate Science and Technology, Marcel Dekker New York 2000, p. 72 ff".

Only one diphenol is used in the case of the homopolycarbonates; two or more diphenols are used in the case of copolycarbonates. The diphenols used, like all the other chemicals and auxiliaries added to the synthesis, may be contaminated with the impurities originating from their own synthesis, handling and storage. However, it is desirable to work with the purest possible raw materials.

The monofunctional chain terminators required for molecular-weight regulation, for example phenols or alkylphenols, in particular phenol, p-tert-butylphenol, isooctylphenol, cumylphenol, chlorocarbonic esters thereof or acyl chlorides of monocarboxylic acids or mixtures of these chain terminators, are either supplied to the reaction with the bisphenoxide(s) or else are added at any desired juncture in the synthesis provided that phosgene or chlorocarbonic acid end groups are still present in the reaction mixture or, in the case of acyl chlorides and chlorocarbonic esters as chain terminators, as long as sufficient phenolic end groups of the resulting polymer are available. However, it is preferable when the chain terminator(s) is/are added after the phosgenation at a location or at a juncture at which phosgene is no longer present but the catalyst has not yet been added or when they are added before the catalyst or together or in parallel with the catalyst.

Any branching agents or branching agent mixtures to be used are added to the synthesis in the same manner, but typically before the chain terminators. Typically, trisphenols, quaterphenols or acid chlorides of tri- or tetracarboxylic acids are used, or else mixtures of the polyphenols or the acid chlorides.

Some of the compounds having three or more than three phenolic hydroxyl groups that are usable as branching agents are, for example, phloroglucinol, 4,6-dimethyl-2,4,6-tri(4-hydroxyphenyl)hept-2-ene, 4,6-dimethyl-2,4,6-tri(4-hydroxyphenyl)heptane, 1,3,5-tris(4-hydroxyphenyl)benzene, 1,1,1-tri(4-hydroxyphenyl)ethane, tris(4-hydroxyphenyl)phenylmethane, 2,2-bis[4,4-bis(4-hydroxyphenyl) cyclohexyl]propane, 2,4-bis(4-hydroxyphenylisopropyl) phenol, tetra(4-hydroxyphenyl)methane.

Some of the other trifunctional compounds are 2,4-dihydroxybenzoic acid, trimesic acid, cyanuric chloride and 3,3-bis(3-methyl-4-hydroxyphenyl)-2-oxo-2,3-dihydroindole.

Preferred branching agents are 3,3-bis(3-methyl-4-hydroxyphenyl)-2-oxo-2,3-dihydroindole and 1,1,1-tri(4-hydroxyphenyl)ethane.

The amount of any branching agents to be used is 0.05 mol % to 2 mol %, again based on moles of diphenols used in each case.

The branching agents may either be included together with the diphenols and the chain terminators in the initially charged aqueous alkaline phase or be added dissolved in an organic solvent before the phosgenation.

All these measures for preparation of the polycarbonates are familiar to those skilled in the art.

Aromatic dicarboxylic acids suitable for the preparation of the polyestercarbonates are, for example, orthophthalic acid, terephthalic acid, isophthalic acid, tert-butylisophthalic acid, 3,3'-diphenyldicarboxylic acid, 4,4'-diphenyldicarboxylic acid, 4,4-benzophenonedicarboxylic acid, 3,4'-benzophenonedicarboxylic acid, 4,4'-diphenyl ether dicarboxylic acid, 4,4'-diphenyl sulfone dicarboxylic acid, 2,2-bis(4-carboxyphenyl)propane, trimethyl-3-phenylindane-4,5'-dicarboxylic acid.

Among the aromatic dicarboxylic acids, particular preference is given to using terephthalic acid and/or isophthalic acid.

Derivatives of the dicarboxylic acids are the dicarbonyl halides and the dialkyl dicarboxylates, especially the dicarbonyl chlorides and the dimethyl dicarboxylates.

The carbonate groups are replaced essentially stoichiometrically and also quantitatively by the aromatic dicarboxylic ester groups, and so the molar ratio of the coreactants is also reflected in the finished polyester carbonate. The aromatic dicarboxylic ester groups can be incorporated either randomly or in blocks.

Preferred modes of preparation of the polycarbonates for use in accordance with the invention, including the polyestercarbonates, are the known interfacial process and the known melt transesterification process (cf. e.g. WO 2004/063249 A1, WO 2001/05866 A1, U.S. Pat. Nos. 5,340,905 A, 5,097,002 A, 5,717,057 A).

In the former case the acid derivatives used are preferably phosgene and optionally dicarbonyl dichlorides; in the latter case preferably diphenyl carbonate and optionally dicarboxylic diesters. Catalysts, solvents, workup, reaction conditions etc. for polycarbonate preparation or polyestercarbonate preparation are sufficiently well-described and known in both cases.

Particular preference is given to using a copolycarbonate of high thermal stability as lens material.

A corresponding copolycarbonate is available, for example, under the "APEC®" name from Covestro Deutschland AG. This is a copolycarbonate containing one or more monomer units of the formula (1a)

(1a)

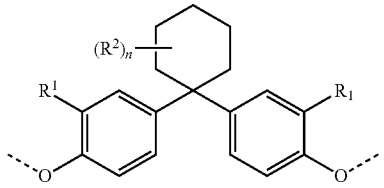

in which $R^1$ is hydrogen or a $C_1$- to $C_4$-alkyl radical, preferably hydrogen, $R^2$ is a $C_1$- to $C_4$-alkyl radical, preferably methyl radical, n is 0, 1, 2 or 3, preferably 3.

The polycarbonate of high thermal stability is alternatively a copolycarbonate containing one or more monomer units of the formulae (1b), (1c), (1d) and/or (1e), which are shown below.

(1b)

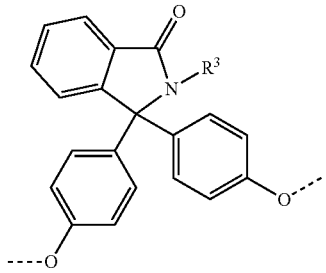

(1c)

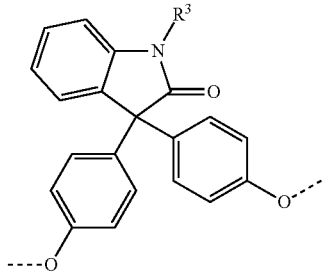

(1d)

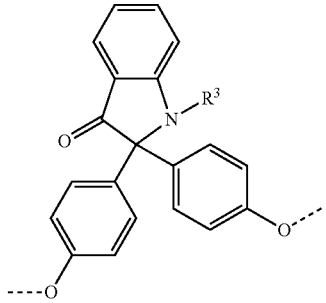

in which $R^3$ is a $C_1$- to $C_4$-alkyl radical, aralkyl radical or aryl radical, preferably a methyl radical or phenyl radical, most preferably a methyl radical, and/or one or more monomer units of a siloxane of the general formula (1e)

(1e)

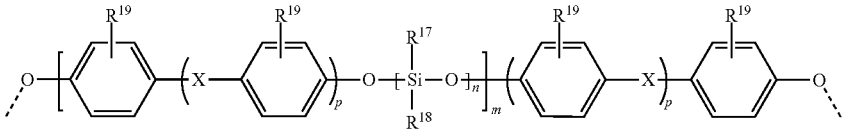

in which $R^{19}$ is hydrogen, Cl, Br or a $C_1$- to $C_4$-alkyl radical, preferably hydrogen or a methyl radical, more preferably hydrogen, $R^{17}$ and $R^{18}$ are the same or different and are each independently an aryl radical, a $C_1$- to $C_{10}$-alkyl radical or a $C_1$- to $C_{10}$-alkylaryl radical, preferably each a methyl radical, and where X is a single bond, —CO—, —O—, a $C_1$- to $C_6$-alkylene radical, a $C_2$- to $C_5$-alkylidene radical, a $C_5$- to $C_{12}$-cycloalkylidene radical or a $C_6$- to $C_{12}$-arylene radical which may optionally be fused to further aromatic rings containing heteroatoms, where X is preferably a single bond, a $C_1$- to $C_5$-alkylene radical, a $C_2$- to $C_5$-alkylidene radical, a $C_5$- to $C_{12}$-cycloalkylidene radical, —O— or —CO—, further preferably a single bond, an isopropylidene radical, a $C_5$- to $C_{12}$-cycloalkylidene radical or —O—, most preferably an isopropylidene radical, n is a number from 1 to 500, preferably from 10 to 400, more preferably from 10 to 100, most preferably from 20 to 60, m is a number from 1 to 10, preferably from 1 to 6, more preferably from 2 to 5, p is 0 or 1, preferably 1, and the value of n×m is preferably between 12 and 400, further preferably between 15 and 200, where the siloxane is preferably reacted with a polycarbonate in the presence of an organic or inorganic salt of a weak acid having a $pK_A$ of 3 to 7 (25° C.), is employed.

Copolycarbonates having monomer units of the formula (1e) and especially also the preparation thereof are described in WO 2015/052106 A2.

However, the copolycarbonate preferably contains monomer units of the general formula (1a).

The monomer unit(s) of the general formula (1a) is/are introduced via one or more corresponding diphenols of the general formula (1a'):

(1a')

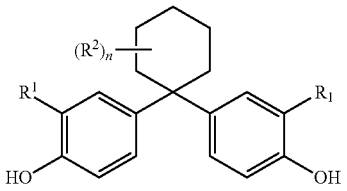

in which $R^1$ is hydrogen or a $C_1$- to $C_4$-alkyl radical, preferably hydrogen, $R^2$ is a $C_1$- to $C_4$-alkyl radical, preferably a methyl radical, and n is 0, 1, 2 or 3, preferably 3.

The diphenols of the formula (1a') and the use thereof in homopolycarbonates are disclosed in the literature (DE 3918406 A1).

Particular preference is given to 1,1-bis(4-hydroxyphenyl)-3,3,5-trimethylcyclohexane (bisphenol TMC) having the formula (1a"):

(1a")

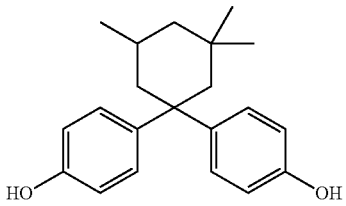

The copolycarbonates having monomer units of the general formulae (1b), (1c) and/or (1d) have high heat distortion resistance and low thermal shrinkage. The Vicat temperature, determined to ISO 306:2013, is typically between 170° C. and 230° C.

The monomer unit(s) of the general formula (1b), (1c) and/or (1d) are introduced via one or more corresponding diphenols of the general formulae (1 b'), (1c') and (1d'):

(1b')

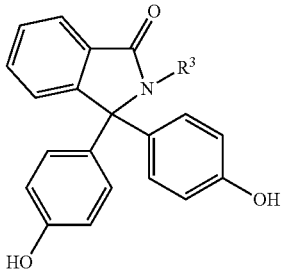

(1c')

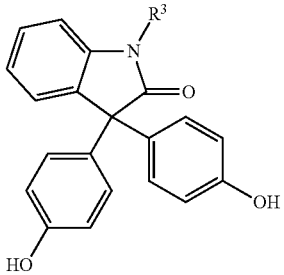

(1d')

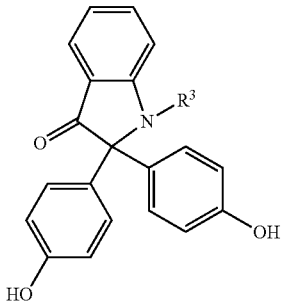

in which $R^3$ is a $C_1$- to $C_4$-alkyl radical, aralkyl radical or aryl radical, preferably a methyl radical or phenyl radical, most preferably a methyl radical.

As well as one or more monomer units of the formulae (1a), (1b), (1c), (1d) and/or (1e), the copolycarbonates used in accordance with the invention may have one or more monomer unit(s) of the formula (2):

(2)

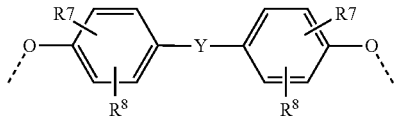

in which $R^7$ and $R^8$ are independently H, a $C_1$- to $C_{18}$-alkyl radical, a $C_1$- to $C_{18}$-alkoxy radical, halogen such as Cl or Br or are each an optionally substituted aryl radical or aralkyl radical, preferably H or a $C_1$- to $C_{12}$-alkyl radical, more preferably H or a $C_1$- to $C_8$-alkyl radical and most preferably H or a methyl radical, and Y is a single bond, —$SO_2$—, —CO—, —O—, —S—, a $C_1$- to $C_6$-alkylene radical or $C_2$- to $C_5$-alkylidene radical, or else a $C_6$- to $C_{12}$-arylene radical which may optionally be fused to further aromatic rings containing heteroatoms.

The monomer unit(s) of the general formula (2) is/are introduced via one or more corresponding dihydroxyaryl compounds of the general formula (2a):

(2a)

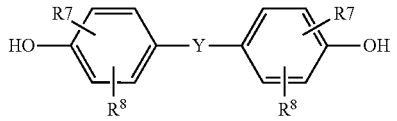

where $R^7$, $R^8$ and Y are each as already defined in connection with formula (2).

Examples of the dihydroxyaryl compounds of the formula (2a) which may be used in addition to the dihydroxyaryl compounds of the formula (1a'), (1b'), (1c') and/or (1d') include hydroquinone, resorcinol, dihydroxybiphenyls, bis(hydroxyphenyl)alkanes, bis(hydroxyphenyl) sulfides, bis(hydroxyphenyl) ethers, bis(hydroxyphenyl) ketones, bis(hydroxyphenyl) sulfones, bis(hydroxyphenyl)sulfoxides, α,α'-bis(hydroxyphenyl)diisopropylbenzenes and the ring-alkylated and ring-halogenated compounds thereof and also α,ω-bis(hydroxyphenyl)polysiloxanes.

Preferred dihydroxyaryl compounds of formula (2a) are, for example, 4,4'-dihydroxybiphenyl (DOD), 4,4'-dihydroxybiphenyl ether (DOD ether), 2,2-bis(4-hydroxyphenyl)propane (bisphenol A), 2,4-bis(4-hydroxyphenyl)-2-methylbutane, 1,1-bis(4-hydroxyphenyl)-1-phenylethane, 1,1-bis[2-(4-hydroxyphenyl)-2-propyl]benzene, 1,3-bis[2-(4-hydroxyphenyl)-2-propyl]benzene (bisphenol M), 2,2-bis(3-methyl-4-hydroxyphenyl)propane, 2,2-bis(3-chloro-4-hydroxyphenyl)propane, bis(3,5-dimethyl-4-hydroxyphenyl)methane, 2,2-bis(3,5-dimethyl-4-hydroxyphenyl)propane, bis(3,5-dimethyl-4-hydroxyphenyl) sulfone, 2,4-bis(3,5-dimethyl-4 hydroxyphenyl)-2-methylbutane, 2,2-bis(3,5-dichloro-4-hydroxyphenyl)propane and 2,2-bis(3,5-dibromo-4-hydroxyphenyl)propane.

Particularly preferred dihydroxyaryl compounds are, for example, 2,2-bis(4-hydroxyphenyl)propane (bisphenol A), 4,4'-dihydroxybiphenyl (DOD), 4,4'-dihydroxybiphenyl ether (DOD ether), 1,3-bis[2-(4-hydroxyphenyl)-2-propyl]benzene (bisphenol M), 2,2-bis(3,5-dimethyl-4-hydroxyphenyl)propane, 1,1-bis(4-hydroxyphenyl)-1-phenylethane, 2,2-bis(3,5-dichloro-4-hydroxyphenyl)propane and 2,2-bis(3,5-dibromo-4-hydroxyphenyl)propane.

Very particular preference is given to compounds of the general formula (2b)

(2b)

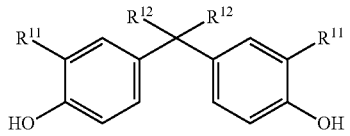

in which $R^{11}$ is H, linear or branched $C_1$- to $C_{10}$-alkyl radicals, preferably linear or branched $C_1$- to $C_6$-alkyl radicals, more preferably linear or branched $C_1$- to $C_4$-alkyl radicals, most preferably H or a $C_1$-alkyl radical (methyl radical), and $R^{12}$ is linear or branched $C_1$- to $C_{10}$-alkyl radicals, preferably linear or branched $C_1$- to $C_6$-alkyl radicals, more preferably linear or branched $C_1$- to $C_4$-alkyl radicals, most preferably a $C_1$-alkyl radical (methyl radical).

In this context, very particular preference is given especially to the dihydroxyaryl compound (2c).

(2c)

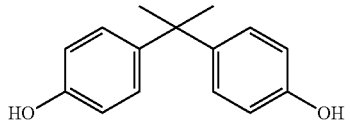

The dihydroxyaryl compounds of the general formula (2a) can be used either alone or in a mixture with one another. The dihydroxyaryl compounds are known from the literature or preparable by methods known from the literature (see, for example, H. J. Buysch et al., Ullmann's Encyclopedia of Industrial Chemistry, VCH, New York 1991, 5th ed., vol. 19, p. 348).

The total proportion of the monomer units of formulae (1a), (1b), (1c) and (1d) in the copolycarbonate is preferably 0.1-88 mol %, more preferably 1-86 mol %, even more preferably 5-84 mol % and especially 10-82 mol % (based on the sum total of the moles of dihydroxyaryl compounds used).

Preferably, the diphenoxide units of the copolycarbonates of component A derive from monomers having the general structures of the above-described formulae (1a'), further preferably (1a"), and (2a), most preferably (2c).

In another preferred embodiment of the composition according to the invention, the diphenoxide units of the copolycarbonates of component A derive from monomers having the general structures of the above-described formulae (2a) and (1b'), (1c') and/or (1d').

A preferred copolycarbonate is formed from 17% to 62% by weight of bisphenol A and 83% to 38% by weight of comonomer of the general formula (1b), (1c) and/or (1d), where the amounts of bisphenol A and comonomer of the general formulae (1b), (1c) and/or (1d) add up to 100% by weight.

The proportion of monomer units of the formula (1a), preferably of bisphenol TMC, in the copolycarbonate is preferably 10-95% by weight, further preferably 44% to 85% by weight. The monomer of the formula (2) used here is preferably bisphenol A, the proportion of which is preferably 15% to 56% by weight. More preferably, the copolycarbonate is formed from the monomers bisphenol TMC and bisphenol A.

The copolycarbonates used in accordance with the invention preferably have a Vicat softening temperature, determined according to ISO 306:2013, of 150 to 230° C., further preferably of 160° C. to 220° C., more preferably 175° C. to 220° C., most preferably of 180° C. to 218° C.

The copolycarbonates may be in the form of block copolycarbonate and random copolycarbonate. Particular preference is given to random copolycarbonates.

The ratio of the frequency of the diphenoxide monomer units in the copolycarbonate is calculated here from the molar ratio of the dihydroxyaryl compounds used.

The relative solution viscosity of the copolycarbonates determined according to ISO 1628-4:1999 is preferably in the range of 1.15-1.35.

The weight-average molar masses $M_w$ of the copolycarbonates are preferably 15 000 to 40 000 g/mol, more preferably 17 000 to 36 000 g/mol, most preferably 17 000 to 34 000 g/mol, and are determined by means of GPC in methylene chloride against polycarbonate calibration.

The stop system is a combination of a first stop with a first color filter and a second stop with a second color filter, i.e. the stop system comprises a first color filter and a second color filter.

The first stop and/or the second stop may each consist of just one color filter. Alternatively, the first stop and/or the second stop preferably each comprise a frame as well as the color filter.

It is within the scope of the invention when, as well as the obligatory first stop and the obligatory second stop, one or more further stops are additionally provided, preferably between the first stop and the second stop.

In the case of the stops used in accordance with the invention, the first color filter and/or the second color filter has a flat surface or a curved surface, "surface" meaning the surface through which the optical axis runs.

If the projection spotlight module is used as a low-beam light, the first color filter and the second color filter are preferably of the same shape, meaning that the outline of the two color filters is the same viewed along the optical axis, and the thickness of the two stops, i.e. the extent along the optical axis (stop depth), is the same or different.

The wavelength range a preferably corresponds to blue light, while the wavelength range b preferably corresponds to yellow light. In the case of optimal positioning of the two color filters at the respective focal points, the color fringe can be entirely eliminated.

An "arrangement of the light source at the first focal point of the lens", in the ideal case of a point light source, leads to a parallel beam path of the projected light. The invention encompasses those arrangements in which the light source is disposed close to the first focal point. Such arrangements lead to a virtually parallel beam path of the projected light. "Virtually" here means a deviation of 5%, preferably 2%, further preferably of 1%, based on the total distance between the adjacent surfaces of lens and reflector along the optical axis. If the system comprises multiple lenses, what is meant here is the lens closest to the reflector along the optical axis. This definition of "virtually" is also applicable to the other use of the word in the context of the description of this invention, as in relation to the positioning of the various elements of the projection spotlight module.

The color filters used differ by the respective spectral transmittance, matched to the spectral properties of the centers of emission.

One or both color filters are preferably selected from the group of the dichroic filters or the gel-type filters.

Preferably, there is variation in the average pure transmittance, i.e. transmittance without surface reflection, determined to CIE 38:1977, within a color filter at right angles to the optical axis. As a result, the color filter as such simultaneously assumes the function of a stop, which is required to produce low-beam light. Therefore, the stop need not comprise any further components except for the color filter, in particular any frame. Variation of the average spectral pure transmittance of the color filters at right angles to the optical axis can preferably be achieved by printing, preferably with substrate material otherwise remaining constant over the entire color filter, by laser structuring and/or thin-layer methodology, or by varying the filter thickness in a location-dependent manner. The latter can be achieved especially in that the color filter is in wedge-shaped form.

If the spectral region of light for any color region, yellow for instance, is particularly broad and multiple wavelengths are similarly dominant, it is also possible to use further color filters disposed at the corresponding focal points of the other "dominant" wavelengths.

A color fringe can be reduced further in a projection spotlight module of the invention when the color filters are provided with a bevel. The bevel is preferably wedge-shaped.

In the region of the bevel too, transmittance, determined to CIE 38:1977, is location-dependent. A "bevel" is a beveled face at an edge of a color filter. A bevel preferably has an angle of 45° to the plane.

If the color filters have a bevel, the beveling is preferably effected by grinding or laser treatment, or by means of plastic injection molding.

Preferably, if multiple color filters with a bevel are being utilized, the bevels of the color filter have the same orientation. Even in the case of different orientation of the bevels, however, there is a measurable reduction in the intensity of the color fringe compared to a system composed of the unbeveled color filters. In the case of different orientation of the bevels, however, more scatter effects occur.

Materials used for the color filters are preferably thermoplastic compositions, for example based on polycarbonate. Preference is given to using a color filter composed of a polycarbonate composition. "Based on" means that the thermoplastic composition contains at least 50% by weight, preferably at least 60% by weight, further preferably at least 75% by weight, most preferably at least 85% by weight, of polycarbonate.

In respect of the polycarbonate compositions that can be used for the color filters, the same statements that have already been made for the polycarbonate compositions of the lens are applicable. More particularly, particular preference is given here too to the use of copolycarbonates of high thermal stability.

Further suitable thermoplastic compositions for the color filters are, for example, those based on polystyrene, polyamides, polyesters, especially polyethylene terephthalate, polyphenylene sulfides, polyphenylene oxides, polysulfones, poly(meth)acrylates, especially polymethylmethacrylate, polyimides, polyether imides, polyether ketones.

Alternatively, the material used for the color filters is preferably a glass material.

Preferably, the light rays are as far as possible not deflected from their direction by the thermoplastic material on passage through the color filters. For this purpose, the surface of the color filters has to be very smooth and the thermoplastic material should be free of volume scatter, especially of scatter particles and air pockets.

It is also within the scope of the invention when one of the color filters is based on a thermoplastic material and the other color filter is based on a glass material.

Projection spotlight modules of the invention are preferably used for lighting in the automotive sector, of utility vehicles, of rail vehicles, of two-wheeled vehicles, especially in each case as front headlights, of ships, as theater spotlights, as architectural lighting, for instance for the lighting of facades or display windows, or as aircraft lighting, for instance as cabin lighting or landing lights.

Figure 2:
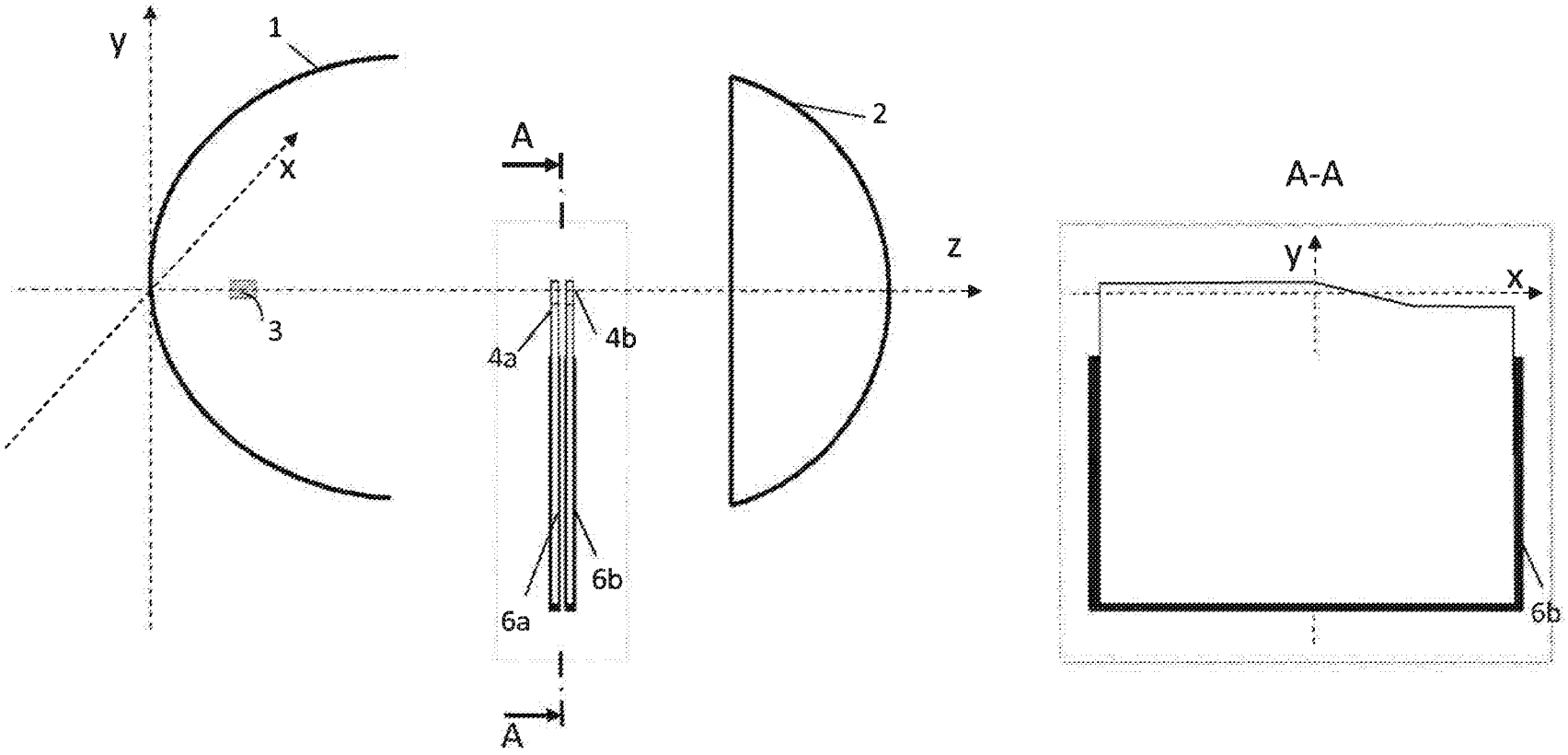
Figure 3:
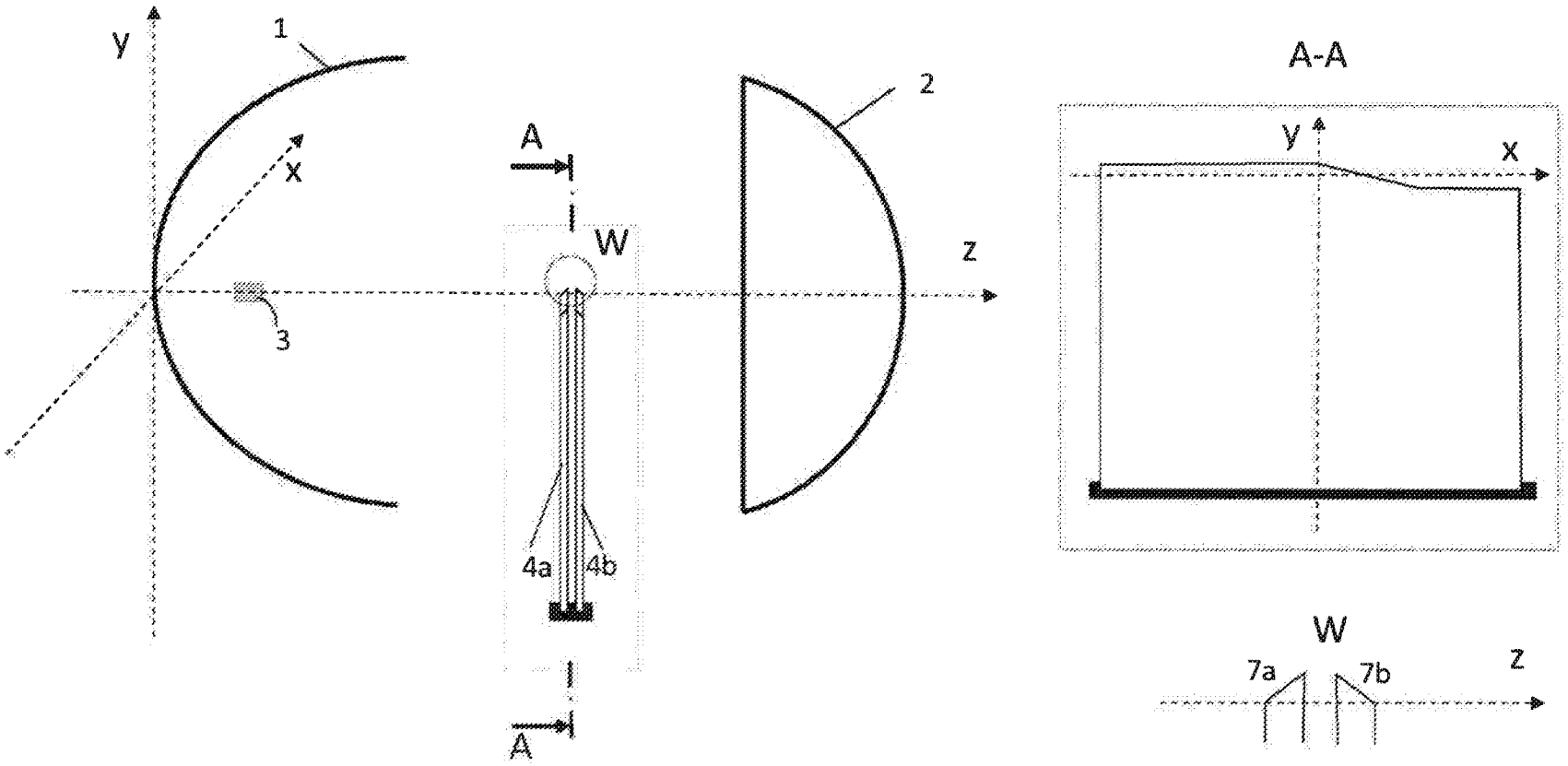
Figure 4:
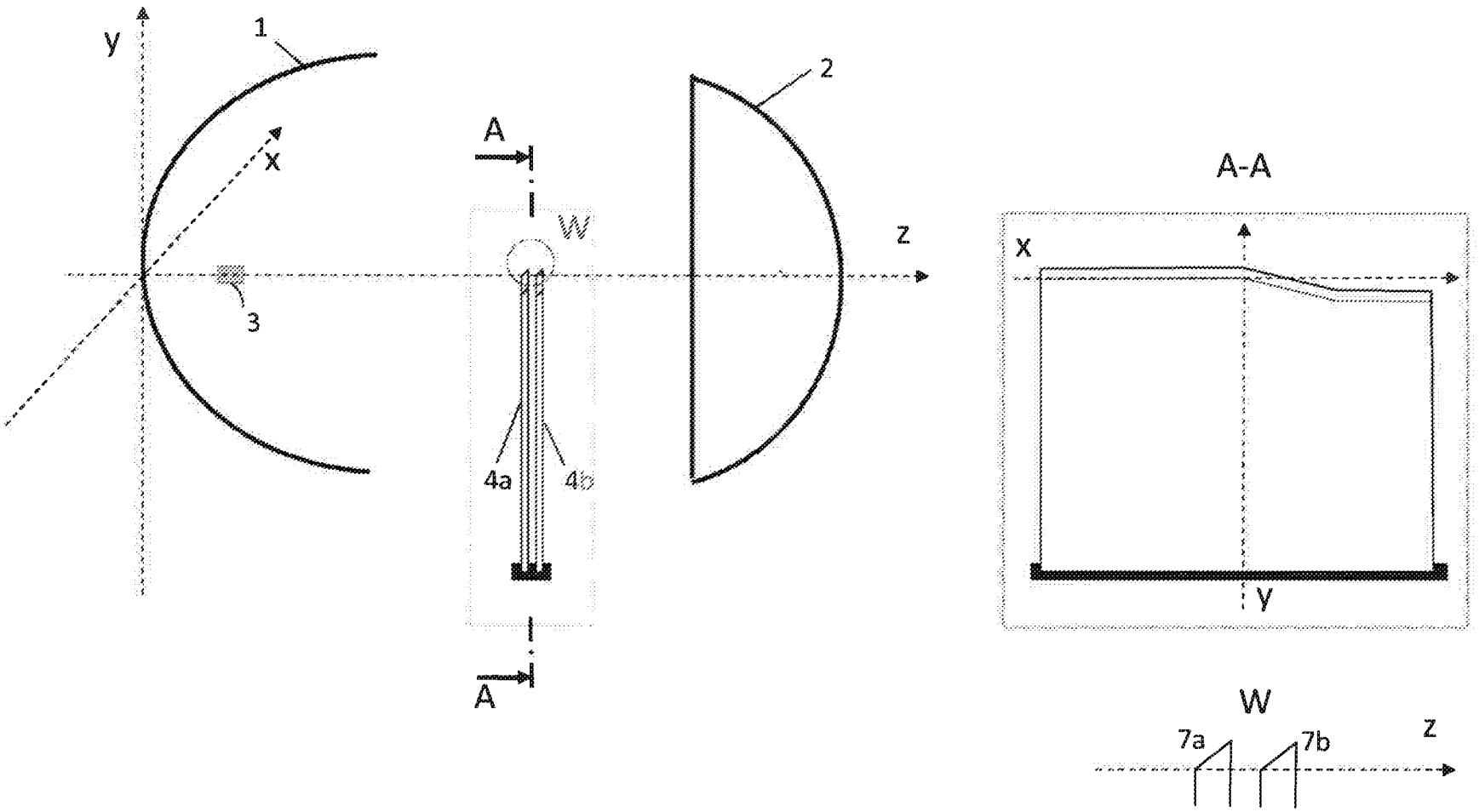
Figure 5A:
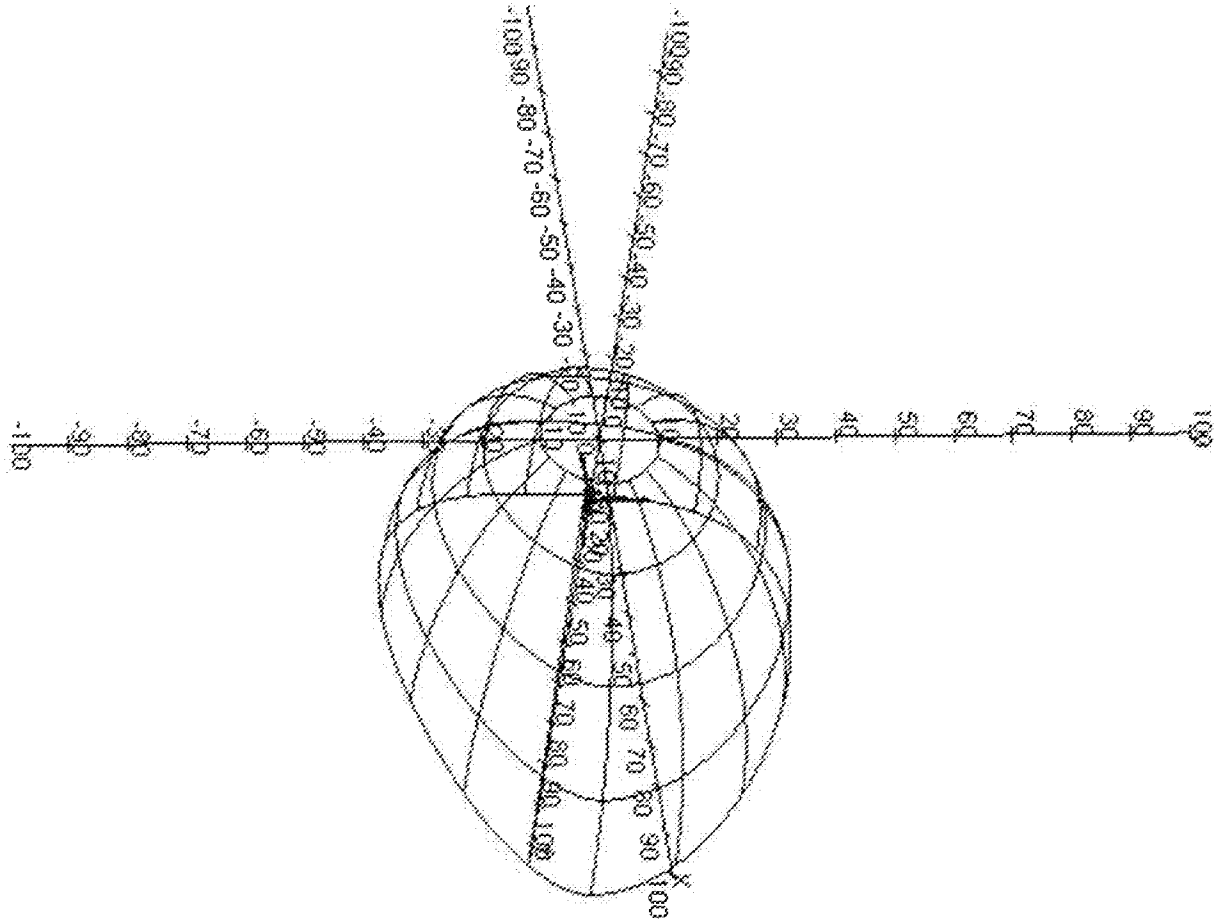
Figure 5B:
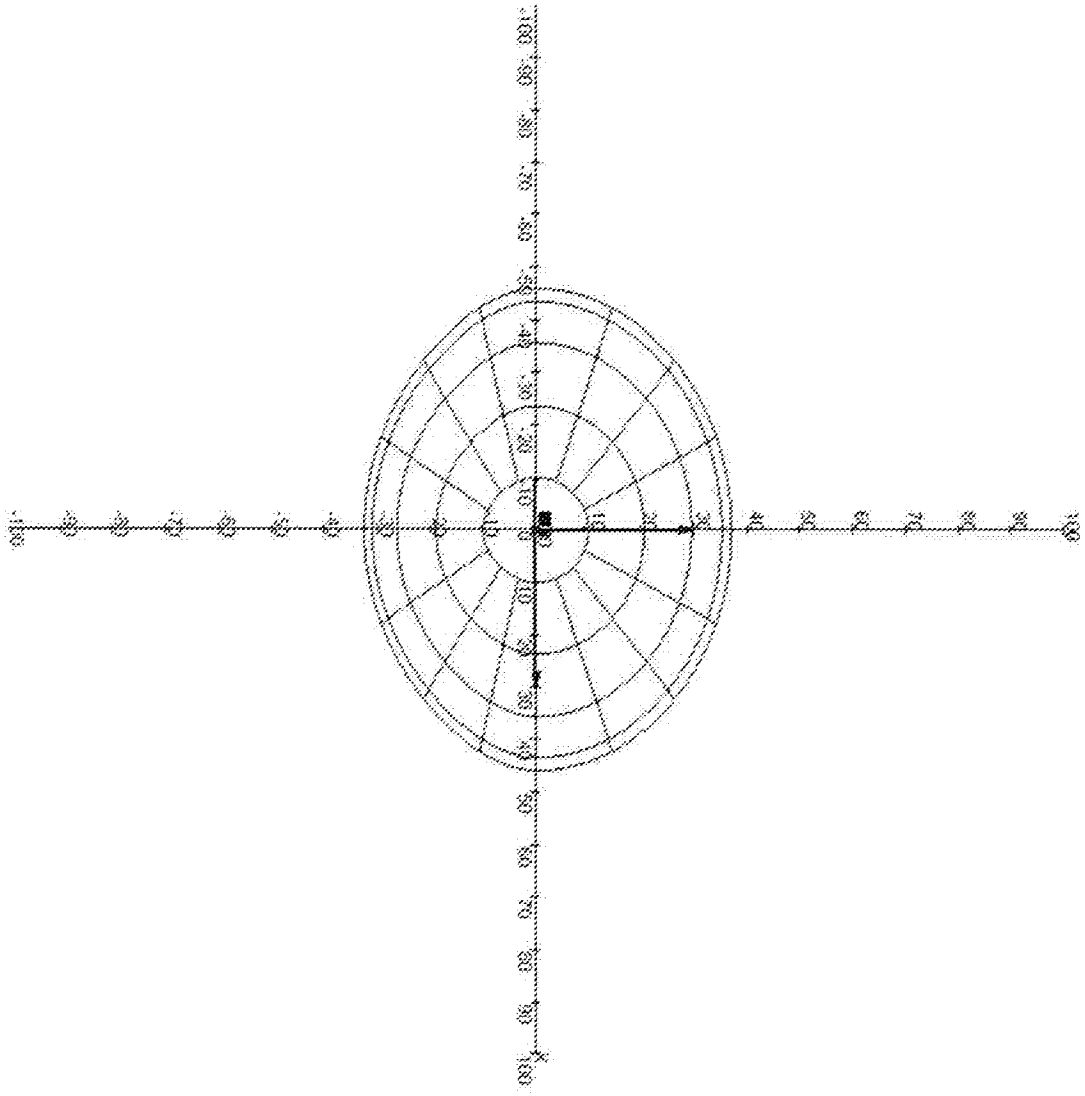
Figure 5C:
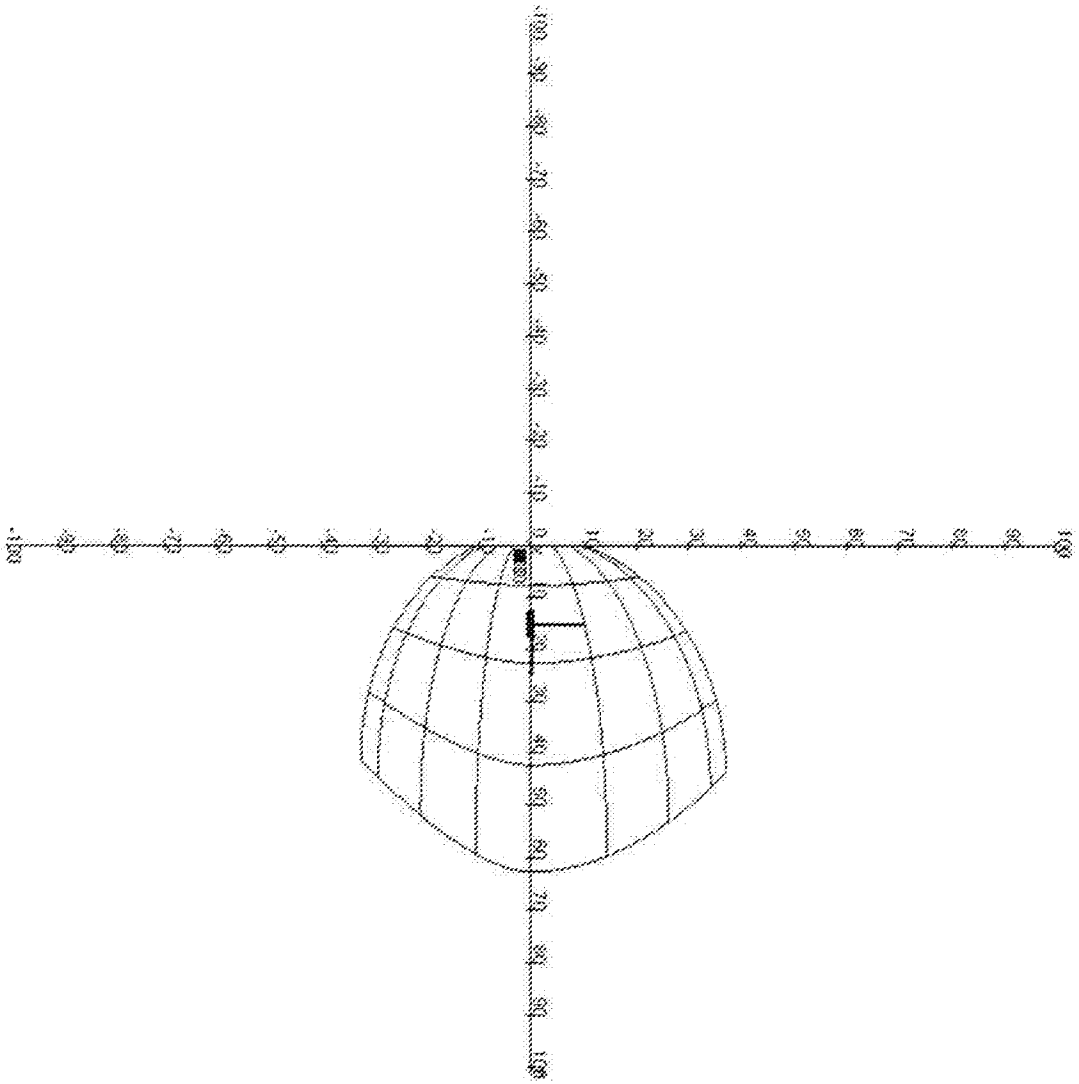
Figure 5D:
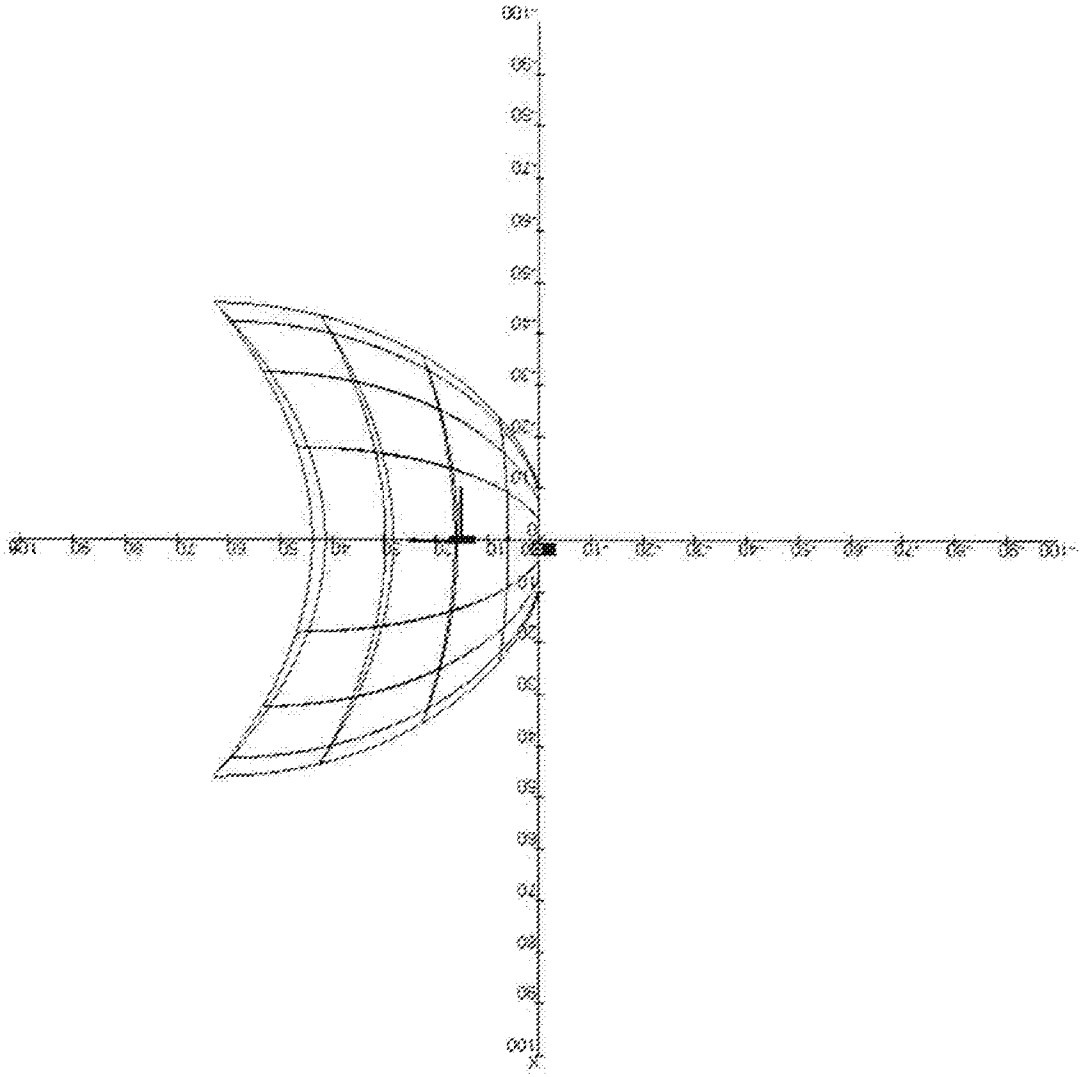

The invention is illustrated in detail by FIGS. 1 to 5:

FIG. 1: Cross section through the essential elements of one embodiment of a projection spotlight module of the invention;

FIG. 2: As FIG. 1, except that the two stops (twin stop) additionally comprise frames;

FIG. 3: As FIG. 1, except with beveled color filters, where the bevels have different orientation;

FIG. 4: As FIG. 1, except with beveled color filters, where the bevels have the same orientation;

FIG. 5: Various views of an ellipsoidal reflector as used in the example.

FIG. 1 shows a projection spotlight module of the invention. The optical axis runs here along the z axis in a theoretical coordinate system. On the optical axis lie an ellipsoidal reflector 1, a lens 2 and a light source 3. The light source 3 is positioned at the first focal point of the reflector 1. Stops with color filters 4*a*, 4*b* are positioned at the ascertained focal points 5*a*, 5*b* of the respective dominant wavelengths of the individual spectral regions, at right angles to the optical axis between the ellipsoidal reflector 1 and the lens 2.

FIG. 2 shows a variant of FIG. 1 in which the stops, as well as the color filters 4*a*, 4*b*, each include frames 6*a*, 6*b*.

In the embodiment in FIG. 3, by contrast, the color filters 4*a*, 4*b* are provided with a bevel 7*a*, 7*b* at a 45° angle. The bevels 7*a*, 7*b* of the two color filters 4*a*, 4*b* have different orientation here. The bevel 7*a* of color filter 4*a* is oriented toward the reflector 1, while the bevel 7*b* of color filter 4*b* is oriented toward the lens 2.

In the embodiment in FIG. 4, the bevels 7*a*, 7*b* have the same orientation and both point in the direction of the reflector 1.

EXAMPLES

In this series of experiments, the effects of different optical properties of the two stops on the color fringe were examined.

The projection spotlight module for low-beam light was simulated. The construction encompassed a spatially extended—cylindrical—light source having a radius of 0.61 mm and a length of 5 mm, the surface of which emitted with Lambertian emission properties and the spectrum of an Osram OSTAR LED ultra white with a luminous flux of 1150 lm. The centroid of the cylindrical light source was disposed at the first focal point of a freeform surface reflector. The first focal length of the reflector, the shape of which is shown in FIGS. 5*a* to 5*d*, was 15 mm; the second focal length was 70 mm. The radius of the reflector in x direction was 46 mm and in y direction 35 mm.

The lens was an aspherical lens having a lens diameter of 70 mm and having a focal length of 30 mm. The lens material was a polycarbonate composition having a refractive index of 1.586 (at a wavelength of 589 nm).

The refractive index of the lens varied as a function of the wavelength λ.

| λ [nm] | n |
|---|---|
| 400 | 1.619 |
| 500 | 1.596 |
| 600 | 1.584 |
| 700 | 1.576 |
| 800 | 1.571 |

The distance between lens and reflector was 100 mm.

The system was suitable for producing a light distribution according to ECE R98.

The stops each had a material thickness of 0.5 mm and consisted of a color filter of a polycarbonate material.

The first color filter had an average spectral pure transmittance, determined to CIE 38:1977, which had a value of 5% for wavelength range a—380 nm to 474 nm—and a value of 100% for wavelength range b—475 nm to 780 nm.

The second color filter had a spectral pure transmittance determined to CIE 38:1977 having a value of 100% for wavelength range a and a value of 5% for wavelength range b.

When the system was viewed along the optical axis, no blue fringe was apparent any longer.

A second experimental setup corresponding to the above-described experiment was chosen, in which the two color filters had a bevel. The bevels (45°) of the two color filters were in a mirror-image orientation (FIG. 3).

Here too, no blue fringe was apparent any longer. Moreover, the resultant color valences in vertical section through the optical axis in this setup were even closer to the achromatic point than in the first experimental setup.

A third experimental setup corresponding to the above-described experiments was chosen, in which the two color filters also had a bevel. The bevels (45°) of the two color filters had the same orientation (FIG. 4).

Here too, no blue fringe was apparent any longer. The resultant color valences in vertical section through the optical axis in this setup were even closer to the achromatic point than in the first experimental setup and in the second experimental setup.

In all cases, the efficiency of the system was not changed significantly by the specific stop arrangement with the two color filters by comparison with a conventional system with an absorbing stop.

In all cases, the criterion with regard to the minimum sharpness of 0.08 required according to ECE R98 was also fulfilled.

The invention claimed is:

1. A projection spotlight module comprising a reflector with a first focal point and a second focal point, an LED light source, the light from which is composed of a first wavelength range a from 380 nm to 474 nm and of light from a second wavelength range b from 475 nm to 780 nm, where the light source is disposed at the first focal point of the reflector or close to the first focal point of the reflector, a lens that has its focal point in common with the second focal point of the reflector, and a stop system, wherein the stop system comprises a first color filter and a second color filter, wherein the first color filter is disposed at the focal point of the lens or close to the focal point of the lens for a characteristic of the wavelength range a or at a light intensity-averaged centroid of the array of focal points of the light rays for individual wavelengths of the wavelength range a of the lens and the second color filter is disposed at the focal point of the lens or close to the focal point of the lens for a characteristic of the wavelength range b or at or close to the light intensity-averaged centroid of the array of focal points of the light rays for the individual wavelengths of the wavelength range b of the lens, with determination of light intensity in each case to DIN 5031-3 (1982), and wherein the first color filter has an average spectral pure transmittance, determined to CIE 38:1977, having a value of at most 15% for a wavelength range a and a value of at least 85% for a wavelength range b, and the second color filter has an average spectral pure transmittance, determined to CIE 38:1977, having a value of at least 85% for wavelength range a and a value of at most 15% for wavelength range b.

2. The projection spotlight module as claimed in claim 1, wherein the first color filter is disposed at the focal point of the lens or close to the focal point of the lens for a dominant wavelength of the wavelength range a and the second color filter at the focal point of the lens or close to the focal point of the lens for a dominant wavelength of the wavelength range b.

3. The projection spotlight module as claimed in claim 1, wherein the first color filter is disposed at the focal point of the lens for a wavelength of maximum intensity of the wavelength range a and the second color filter at the focal point of the lens for a wavelength of maximum intensity of the wavelength range b.

4. The projection spotlight module as claimed in claim 1, wherein the first color filter is disposed at or close to the light intensity-averaged centroid of the array of focal points of the light rays for the individual wavelengths of wavelength range a of the lens, and the second color filter at or close to the light intensity-averaged centroid of the array of focal points of the light rays for the individual wavelengths of the wavelength range b of the lens, with determination of light intensity to DIN 5031-3 (1982).

5. The projection spotlight module as claimed in claim 1, wherein the reflector is an ellipsoidal reflector.

6. The projection spotlight module as claimed in claim 1, wherein the reflector is a freeform surface reflector.

7. The projection spotlight module as claimed in claim 1, wherein the color filters include a bevel having an orientation.

8. The projection spotlight module as claimed in claim 7, wherein the bevels of the color filters have the same orientation.

9. The projection spotlight module as claimed in claim 1, wherein the light source includes a phosphor excited by a laser.

10. The projection spotlight module as claimed in claim 1, wherein the light from the light source has a correlated color temperature, determined to CIE 15:2004, of 5000 to 6000 K.

11. The projection spotlight module as claimed in claim 1, wherein the first color filter has an average spectral pure transmittance, determined to CIE 38:1977, having a value of at most 5% for wavelength range a and a value of at least 99% for wavelength range b, and the second color filter has an average spectral pure transmittance, determined to CIE 38:1977, having a value of at least 99% for wavelength range a and a value of at most 5% for wavelength range b.

12. The projection spotlight module as claimed in claim 1, wherein the first color filter and/or of the second color filter consists of a polycarbonate-based composition.

13. The projection spotlight module as claimed in claim 1, wherein the lens consists of a polycarbonate-based composition.

14. The projection spotlight module as claimed in claim 1, wherein the pure transmittance, determined to CIE 38:1977, within at least one color filter having an optical axis varies at right angles to the optical axis.

15. A method comprising utilizing the projection spotlight module as claimed in claim 1 for illumination in the automotive sector, of utility vehicles, of rail vehicles, of two-wheeled vehicles, of ships, as theater spotlight, as architectural lighting or as aircraft lighting.

* * * * *